US010916881B2

(12) United States Patent
Vassgård

(10) Patent No.: US 10,916,881 B2
(45) Date of Patent: Feb. 9, 2021

(54) HIGH VOLTAGE WET-MATE CONNECTION ASSEMBLY

(71) Applicant: Benestad Solutions AS, Lierskogen (NO)

(72) Inventor: Johannes Arngrim Vassgård, Rasta (NO)

(73) Assignee: Benestad Solutions AS, Lierskogen (NO)

( * ) Notice: Subject to any disclaimer, the term of this patent is extended or adjusted under 35 U.S.C. 154(b) by 0 days.

(21) Appl. No.: 16/621,286

(22) PCT Filed: Jun. 7, 2018

(86) PCT No.: PCT/EP2018/064952
§ 371 (c)(1),
(2) Date: Dec. 11, 2019

(87) PCT Pub. No.: WO2018/228897
PCT Pub. Date: Dec. 20, 2018

(65) Prior Publication Data

US 2020/0119485 A1 Apr. 16, 2020

(30) Foreign Application Priority Data

Jun. 16, 2017 (NO) ..... 20170997

(51) Int. Cl.
*H01R 13/52* (2006.01)
*H01R 13/523* (2006.01)
(Continued)

(52) U.S. Cl.
CPC ..... *H01R 13/523* (2013.01); *H01R 13/2421* (2013.01); *H01R 13/521* (2013.01);
(Continued)

(58) Field of Classification Search
CPC ..... H01R 13/6456; H01R 13/6272; H01R 13/523; H01R 13/521
See application file for complete search history.

(56) References Cited

U.S. PATENT DOCUMENTS 7,429,193 B2 * 9/2008 Cairns ..... H01R 13/521 439/271
9,077,099 B1 * 7/2015 Hatcher ..... G02B 6/3816
(Continued)

FOREIGN PATENT DOCUMENTS

DE 102012101709 A1 9/2013
EP 2665138 A2 11/2013
(Continued)

OTHER PUBLICATIONS

Georgiadis, Ioannis; International Search Report prepared for PCT/EP2018/064952; dated Sep. 17, 2018; 3 pages.

*Primary Examiner* — James Harvey
(74) *Attorney, Agent, or Firm* — Shackelford, Bowen, McKinley & Norton, LLP

(57) ABSTRACT

A high voltage wet-mate connection assembly (1) with electrically non-connected and connected modes, comprising a receptacle part (100) and a stab part (200). The stab part has an axially movable connection body (250) moving between non-connected and connected positions. The assembly has a connected mode metal encapsulation (50) encapsulating the contact location (40) at a shield distance from the contact location when in the connected position. The connected mode metal encapsulation (50) is in electrical contact with a main receptacle conductor (109), thereby having the same electric potential as the main receptacle conductor (109).

13 Claims, 14 Drawing Sheets

(51) Int. Cl.

| | |
|---|---|
| ***H01R 13/24*** | (2006.01) |
| ***H01R 13/53*** | (2006.01) |
| ***H01R 13/648*** | (2006.01) |
| ***H01R 13/627*** | (2006.01) |
| ***H01R 13/645*** | (2006.01) |

(52) U.S. Cl.
CPC ..... *H01R 13/53* (2013.01); *H01R 13/6272* (2013.01); *H01R 13/6456* (2013.01); *H01R 13/6485* (2013.01)

(56) References Cited

U.S. PATENT DOCUMENTS

| | | | | |
|---|---|---|---|---|
| 9,263,875 | B2 | 2/2016 | Rapp et al. | |
| 9,270,051 | B1 * | 2/2016 | Christiansen ..... | H01R 13/5219 |
| 10,181,677 | B2 * | 1/2019 | Vassgard ..... | H01R 13/6315 |
| 10,608,372 | B2 * | 3/2020 | Brierley ..... | H01R 43/26 |
| 2009/0080836 | A1 * | 3/2009 | Cairns ..... | G02B 6/3816 385/56 |
| 2011/0021049 | A1 | 1/2011 | Ramasubramanian et al. | |
| 2013/0183866 | A1 | 7/2013 | Poulain et al. | |
| 2016/0308300 | A1 | 10/2016 | Lewin et al. | |
| 2017/0242197 | A1 * | 8/2017 | Tucker ..... | H01R 13/5219 |

FOREIGN PATENT DOCUMENTS

| | | | |
|---|---|---|---|
| EP | 2811584 | A1 | 12/2014 |
| FR | 2529396 | A1 | 12/1983 |
| GB | 2389466 | A | 12/2003 |
| WO | WO-2007147755 | A1 | 12/2007 |
| WO | WO-2015199550 | A2 | 12/2015 |

* cited by examiner

HIGH VOLTAGE WET-MATE CONNECTION ASSEMBLY

TECHNICAL FIELD

The present invention relates to a high voltage wet-mate connector.

BACKGROUND ART

A number of challenges arise when designing such subsea power connectors. In particular, as is well known to the skilled person, the combination of high voltage and conducting seawater puts high demands on the connection assembly. Another challenge is to design a connection assembly, which will function as intended after a long period of inactivity. For instance, such connectors may remain in a constant position for several years in a subsea environment, after which they need to function as intended.

A common setup for such connection assemblies is to mate a male and a female portion. Typically, a male pin having a contact face is inserted into the female section until the contact face abuts an oppositely facing female contact face. During the movement of the male pin, it is normally an object to avoid or limit insertion of seawater into the female part.

A typical example of such a subsea electrical connection assembly is shown in patent application publication WO2015199550. In this solution, a male and female part are aligned with respect to each other. Then, a male pin supported in the male part is inserted into the female part. The female part has a movable core arranged in a male pin receiving aperture, which is moved axially into the female part upon insertion of the male pin. A male pin contact face faces radially outwards at a front part of the male pin. In a receiving bore of the female part, a radially inwardly facing contact face abuts the male pin contact face, when in the inserted, connected position.

Another typical example of such a subsea electric connection assembly is shown in FR2529396. When inserting the male pin, a movable core is pushed into the female part, letting radially facing contact electric contacts mate with opposite electric contacts in the female bore. The male pin is movably supported within a male housing, which is aligned with a female housing before inserting the male pin. At a base end, the male housing is flexibly supported with elastic spacers and resilient sleeves. Thus, the entire male housing may pivot to some extend about its base end. Notably, in the solutions disclosed in FR2529396 and WO2015199550, when inserting the male pin the respective electric contacts will slide against each other until reaching the final, connected position.

Such repeated friction between the contact faces may be detrimental for the electric coupling. Hence, it is an object to provide a novel high voltage subsea connection assembly, which avoids such friction between the contact faces. Avoiding such friction will make it possible to use softer materials on the guiding faces, such as gold.

Another problem encountered when coupling high voltage conductors, is electric field concentration. Excessive electric field concentrations may lead to material deterioration, particularly in the insulating material that surrounds the conducting material. Due to this problem, the design of the conducting material is restricted, since one typically wants to avoid sharp edges that produce electric field concentration.

This problem is described in WO2007147755. Here, excessive field concentration at a triple point at an intersection of an insulating layer, a resistive layer and a semi-conducting layer is solved by choosing an appropriate geometry for the intersection.

Patent publication U.S. Pat. No. 9,263,875 also discloses a solution for this problem.

Publication US20160308300 discloses an electric connector having a male and a female part, where the connector is provided with means for reduction of electric field concentration.

An object of the present invention may be to provide a high voltage wet-mate connection assembly that solves the challenges associated with excessive electric field concentration.

Another object of the present invention may be to provide a high voltage wet-mate connection assembly, which reduces or eliminates sliding of conductors against each other during connection or disconnection.

SUMMARY OF INVENTION

According to the present invention, there is provided a high voltage wet-mate connection assembly configured to be switched between an electrically non-connected mode and an electrically connected mode. It comprises a receptacle part and a stab part. The receptacle part has a main receptacle conductor and the stab part has a main stab conductor. The stab part further has an axially movable connection body, which is configured to move between a non-connected position and a connected position, where the connected position is a position where the connection body is in a state inserted into the receptacle part. The connection body comprises a stab contact face configured to engage a receptacle contact face of the receptacle part at a contact location when in the connected state, thereby providing an electric connection between the main receptacle conductor and the main stab conductor. The connection assembly further comprises a connected mode metal encapsulation, the outer faces of which encapsulate the contact location at a shield distance from the contact location, when in the connected position. The connected mode metal encapsulation is in electrical contact with the main receptacle conductor, thereby having the same electric potential as the main receptacle conductor.

With the term high voltage is herein meant voltages of 1 kV and above.

Moreover, the connected mode metal encapsulation may protect insulating material outside of it, by exhibiting a smooth outer face (i.e. without sharp edges).

As used herein, the term contact location shall mean the location where the contact element or elements, of the receptacle part or the stab part, contact the opposite contact face of the stab part or the receptacle part, respectively, to make the electrical connection. Thus, through this contact location, voltage and/or current may be transmitted through the connection assembly, when in the connected mode.

In some embodiments, the high voltage wet-mate connection assembly further comprises one or more radially movable contact elements, on which the receptacle contact face or the stab contact face is arranged.

The term shield distance, when used herein, shall mean the distance, as measured in any direction such as radial, axial or inclined directions, between any position of contact between the receptacle contact face and the stab contact face, and the outer rim of the connected mode metal encapsulation. Thus, according to the invention, the connected mode metal encapsulation provides an outer conductive face with the same electrical potential as the contact location, at a distance away from the contact location. In this manner, the contact element, which may be a radially movable contact element, at the contact location, is protected from large electrical fields. Such large electric fields would with solutions of the prior art typically appear at the positions of sharp edges. However, since such possible sharp edges have the same electric potential as the connected mode metal encapsulation, such large electric fields will not be present.

Advantageously, the radially movable contact element(s) can be configured to move in a radial direction from a non-connected mode to a connected mode, when the connection body is moved from the non-connected position to the connected position.

Thus, there is advantageously a contact element volume within the connected mode encapsulation, within which the radially movable contact elements can move.

In some embodiments, at the position of the contact location, the connection body can advantageously constitute the connected mode metal encapsulation. In other words, it may be the connection body, which stabs into the receptacle part from the stab part when in the connected mode, that provides the metal encapsulation around the contact location.

According to some embodiments, the one or more radially movable contact elements may carry the receptacle contact face and can be configured to move radially outwards when moving from the non-connected mode to the connected mode.

The components that constitute the connected mode encapsulation may be configured to remain in a constant radial position when the connection assembly switches between the connected mode and the non-connected mode.

In other words, in such embodiments, the parts that constitute the connected mode encapsulation do not move radially during establishment or removal of electric connection of the connection assembly. Advantageously, as a result of this, the part(s) that do move radially are not constituting a part of the connected mode metal encapsulation.

In some embodiments, the high voltage wet-mate connection assembly may further comprise a non-connected mode metal encapsulation, wherein the outer faces of which encapsulate the radially movable contact elements with a shield distance when in the non-connected mode, and wherein the non-connected mode metal encapsulation is in electrical contact with the main receptacle conductor, thereby having the same electric potential as the main receptacle conductor.

By having the radially movable contact elements, and hence the contact face, encapsulated by such a metal encapsulation also when the connection assembly is in the non-connected mode, one may have electric voltage applied to the main receptacle connector without harming the receptacle part due to large electric fields. In particular, one avoids sparking on possible components inside the metal encapsulation due to large voltage in the non-connected state. This feature provides flexibility to the design of a subsea high voltage system.

As the skilled reader will appreciate, when the assembly is in use, such as on a subsea processing facility, the receptacle part and/or the stab part may typically be connected to a high voltage cable. Hence, the cable conductor will in such embodiments be in electrical connection with the main receptacle conductor and/or the main stab conductor.

In some embodiments, the connected mode metal encapsulation can, when in the connected mode, be encapsulated by a connected mode insulation assembly. Advantageously, the connected mode insulation assembly, when in the connected state, encapsulates the connected mode metal encapsulation along the entire axial extension of the contact location and beyond that axial extension in both axial directions.

Advantageously, the non-connected mode metal encapsulation is encapsulated by a non-connected mode insulation assembly, when in the non-connected mode. Advantageously, the non-connected mode insulation assembly defines an enclosed volume having only one aperture, through which the main receptacle conductor enters into the enclosed volume. Moreover, the non-connected mode metal encapsulation is arranged within this enclosed volume. While it is said that the non-connected mode insulation assembly advantageously has only one aperture, such embodiments may involve an additional channel, through which a dielectric fluid may flow. Typically, such a dielectric fluid will be arranged within a dielectric chamber.

The axially movable connection body of the stab part can advantageously comprise a central bore. Moreover, a central front part of the receptacle part can then be configured to be positioned within the central bore when in the connected mode.

In such embodiments, the connection body of the stab part will typically have a sleeve shape.

The receptacle part may have an axially retractable sleeve part, which is configured to be axially moved by a force exerted by the front face of a moving front part of the stab part. Such a front face will typically be the front face of the connection body of the stab part.

In some embodiments, a receptacle part front face may comprise front faces of a central front part, a moving front part, and a receptacle end body, wherein these front faces comprise metal. In such embodiments, when in the non-connected mode, the receptacle part front face will be constituted or be substantially constituted by a metal front face. A metal front face can provide the possibility of cleaning the front face with rough methods, such as by application of a high pressure water jet or a rough cleaning brush.

In some embodiments, a stab part front face may comprise front faces of a central front part, a moving front part and a stab end body, wherein these front faces comprise metal. With such embodiments, also the stab part may be provided with a metal front face.

The receptacle part can further comprise packers that are arranged to slide against the connection body. Such packers can be arranged within the connected mode metal encapsulation and within a shield distance from the outer faces of the connected mode metal encapsulation, when in the connected mode.

Advantageously, when in the connected mode, all the packers that interface with a sliding surface, such as the outer surface of the connection body, are arranged within metal surroundings/within a metal environment. Some of such packers may be arranged within metal that has the same electric potential as the main receptacle conductor, while other packers may have the same potential as the outer metal structure of the connection assembly (i.e. earthed).

In some embodiments, the connected mode metal encapsulation can be in contact with a semiconductor coating of a cable connected to the receptacle part. This may relate to the cable connected to the receptacle part. This may relate to the cable connected to the stab part.

BRIEF DESCRIPTION OF DRAWINGS

While various concepts have been discussed above, a detailed description of an example embodiment will be given in the following with reference to the drawings, in which.

DETAILED DESCRIPTION OF THE INVENTION

Figure 1:
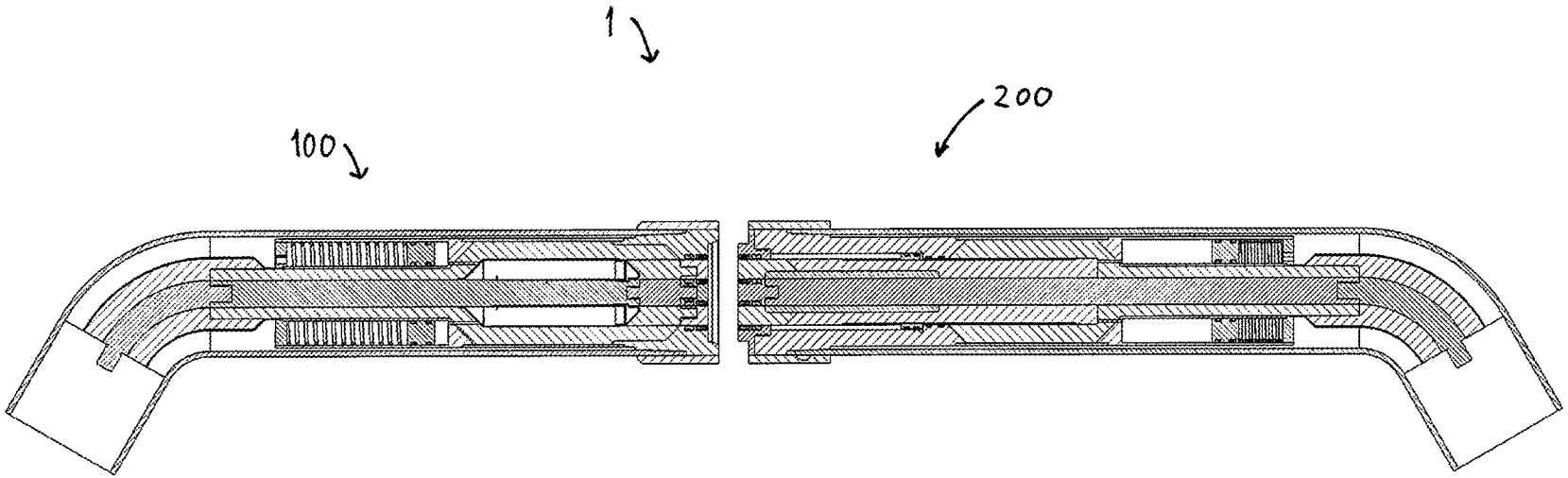
FIG. 1 is a cross section side view of a receptacle part and a stab part of a high voltage wet-mate connection assembly according to the invention.

FIG. 1 depicts a high voltage wet-mate connection assembly 1, which has a receptacle part 100 and a stab part 200. In the shown position in FIG. 1, the receptacle and stab parts 100, 200 are coaxially aligned, but yet not joined together.

Figure 2:
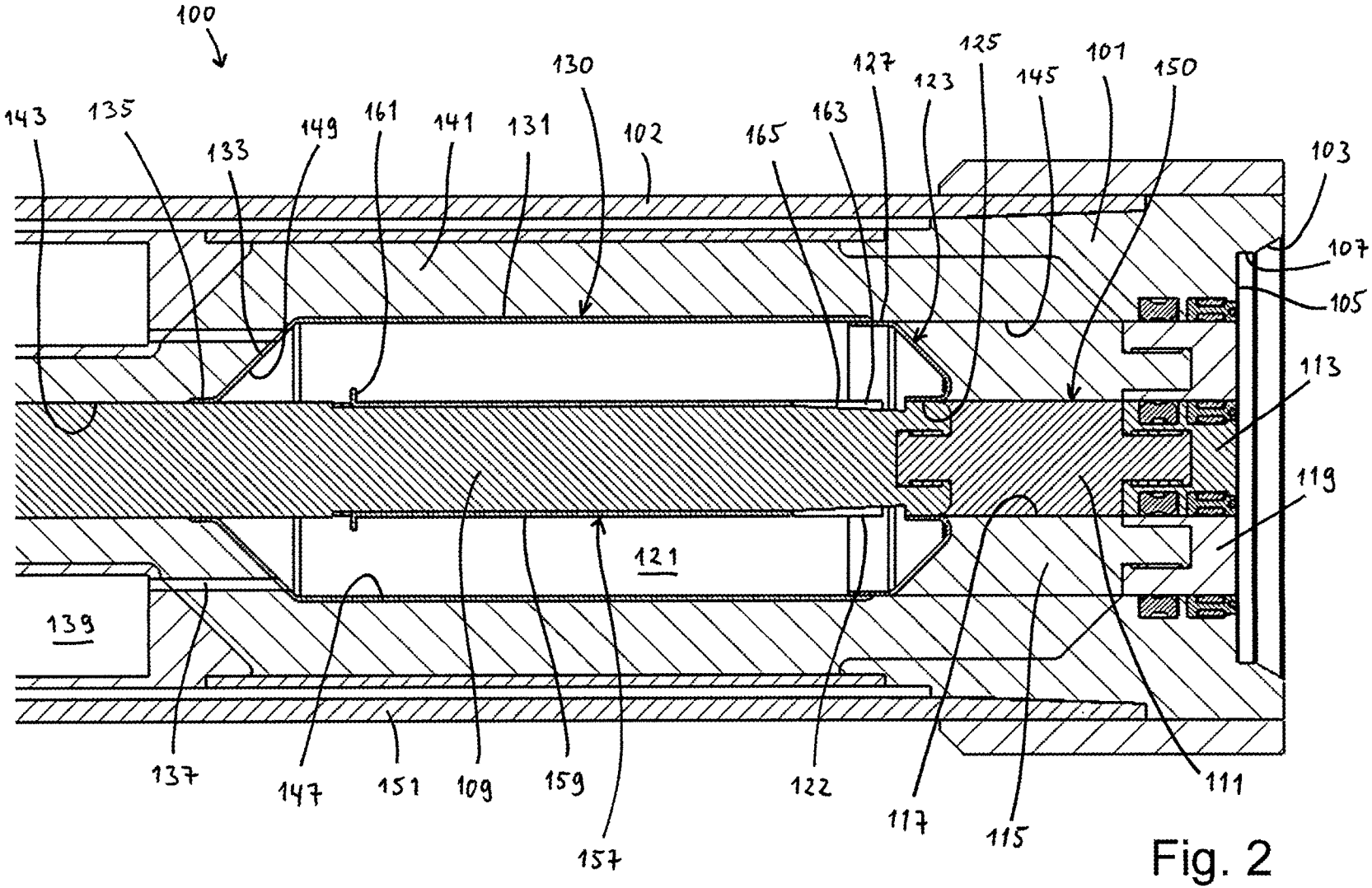
FIG. 2 is a cross section view through the receptacle part.
Figure 4:
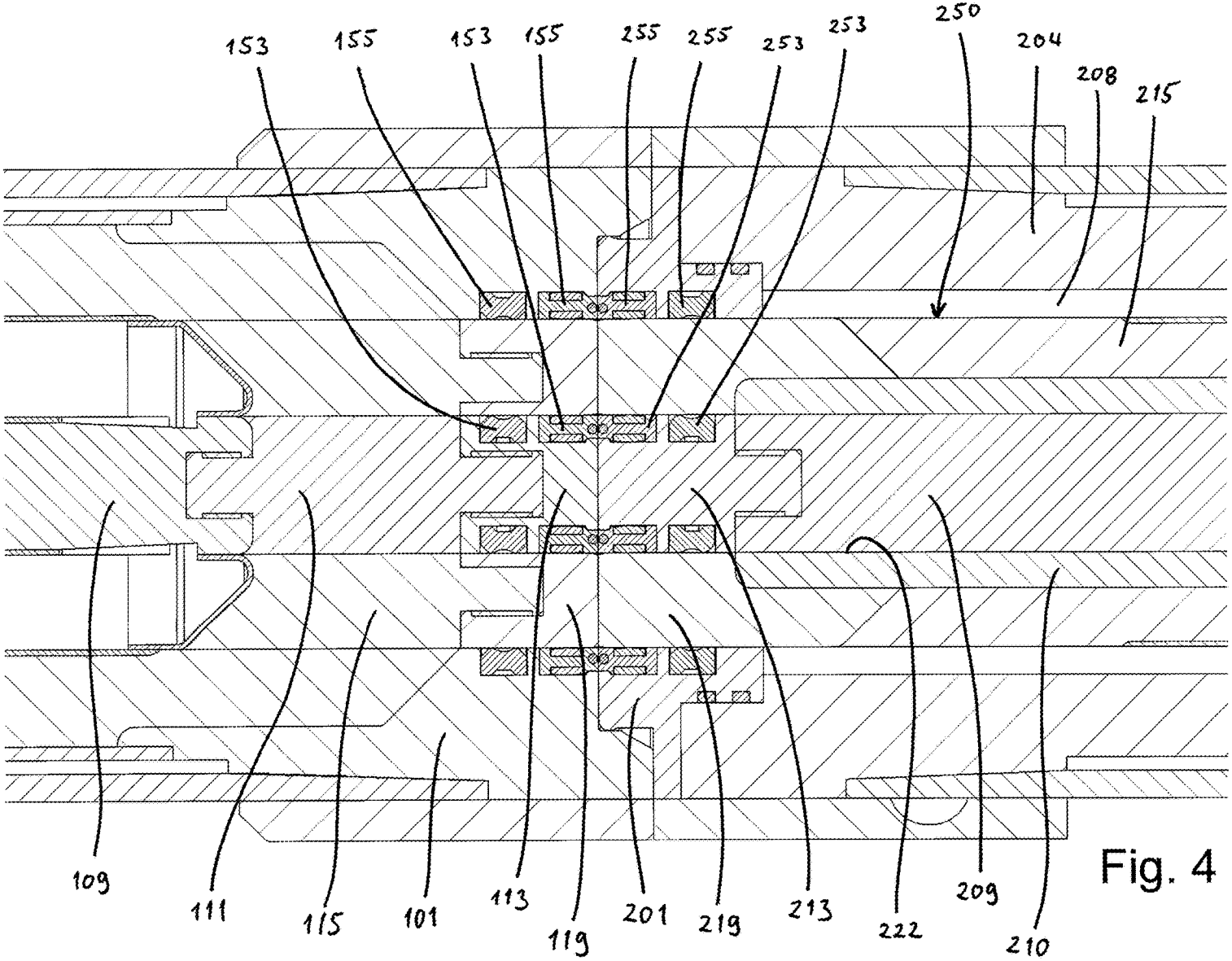
FIG. 4 is an enlarged cross section view through a portion of the receptacle part and stab part, in a joined and aligned, but non-connection position.

FIG. 2 shows a portion of the receptacle part 100 in a non-connected state. It has a receptacle end body 101. The receptacle end body 101 can advantageously be made of metal. The receptacle end body 101 connects to an outer structure sleeve 102, which may be of metal, and which constitutes a large portion of the outer radially facing face of the receptacle part 100. At an axial end, which is configured to abut and align with the stab part 200, the receptacle end body 101 has an inclined guiding face 103. Some distance further rearwards in the axial direction, the receptacle end body 101 further has an end contact face 105, which advantageously may face in a substantially axial direction. Between the inclined guiding face 103 and the end contact face 105, there is an axial guiding face 107, which faces radially inwards. These three faces are provided for mutual alignment between the receptacle part 100 and the stab part 200 as they are brought together. Such a position is shown in FIG. 4.

Still referring to FIG. 2, in the center of the receptacle part 100 there is a main receptacle conductor, here in the form of a central conductor 109. The central conductor 109 is typically electrically connected to a conductor inside a high voltage cable (not shown). Such a cable can typically be a high voltage cable arranged subsea, providing electric power to various machines, such as electric motors, transformers, or heating facilities (e.g. direct electric heating of subsea pipelines). When the connection assembly 1 is in a connected state, electric current may flow through the central conductor 109.

At an axial front end, the central conductor 109 is attached to a central insulator 111. At the opposite axial end of the central insulator 111, the latter is connected to a central front part 113. The central insulator 111 may be connected to the central conductor 109 and the central front part 113 by means of clamping, or by other methods.

While the central conductor 109 is made of an electrically conductive material, such as copper, the central insulator 111 can be made of a robust, electrically insulating material, such as PEEK (polyether ether ketone). The central front part 113 is made of a metal and is thus electrically conductive.

In this embodiment, the central conductor 109, central insulator 111, and the central front part 113 together form a substantially straight cylindrical shape extending axially in the center of the receptacle part 100. As will be discussed further below, when altering between the connected and non-connected modes, the central conductor, central insulator and central front part will retain their axial position with respect to the receptacle main body 101.

In the shown non-connected mode of FIG. 2, a moving insulator 115 has a moving insulator bore 117 that is arranged in such a position that its axial extension overlaps with the axial extension of the central insulator 111. The central insulator 111 is arranged within the moving insulator bore 117 of the moving insulator 115. The moving insulator 115 is also made of an electrically isolating material, such as PEEK. At one axial end of the moving insulator 115, it is connected to a moving front part 119. The moving front part 119 is advantageously made of a metal, for instance the same type of metal as the central front part 113. The moving front part 119 also has an inner bore, which is flush with the moving insulator bore 117.

In the shown embodiment, the axially facing front faces of the central front part 113 and the moving front part 119 are substantially flush with the end contact face 105 of the receptacle end body 101.

Moreover, the axially facing front faces of the central front part 113, the moving front part 119 and the end contact face 105 are metal surfaces. Hence, except for slits between these components, the entire front face of the receptacle part 100 that faces towards the stab part 200 is made of metal. This makes it possible to clean the front face of the receptacle part 100 with a hard water jet and/or brushes, such as for removal of impurities, before joining the receptacle part and stab part together (as shown in FIG. 4).

The moving insulator 115 and the moving front part 119 are configured to slide in an axial direction when moving between the connected and non-connected mode. During such axial movement, the central conductor 109, the central insulator 111, and the central front part 113 remains in their axial, central position. Such movement will be discussed further below.

Figure 5:
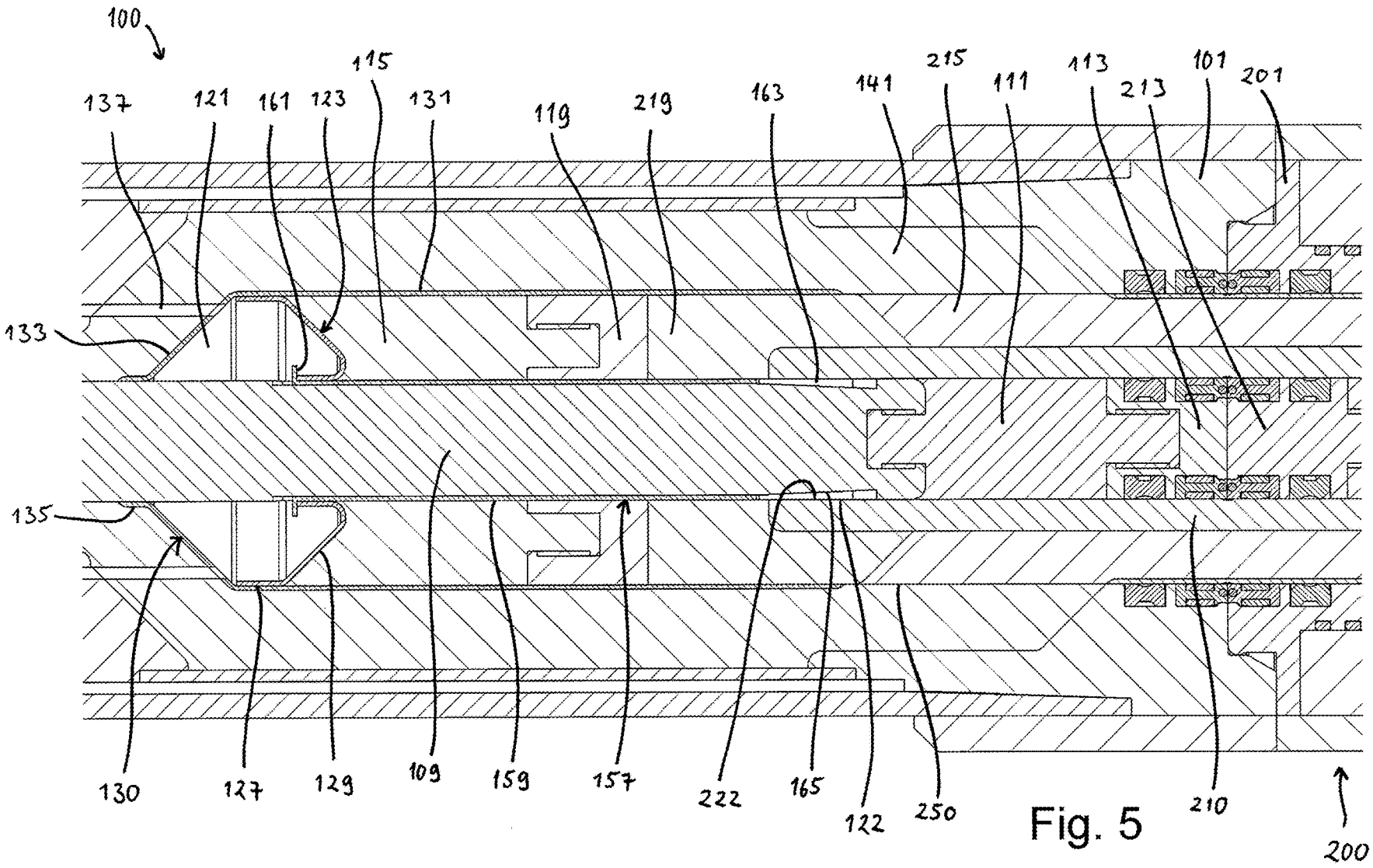
FIG. 5 is a cross section view of the receptacle part in a connected position, wherein some components of the stab part are inserted into the receptacle part.

Still referring to FIG. 2, encompassing a portion of the central conductor 109 is a dielectric chamber 121. The dielectric chamber 121 may be filled with a dielectric liquid, such as oil. At an axial front end of the dielectric chamber 121, the chamber is confined in the axial direction by a sliding shield 123. The sliding shield 123 is attached to the moving insulator 115 and is thus positioned between the moving insulator 115 and the dielectric chamber 121. The sliding shield 123 can be made of a steel sheet material and is electrically conductive, thereby being able to function as an electrical shield. The sliding shield 123 has a sliding shield bore 125. In the shown embodiment, the sliding shield 123 is shaped like a cup. The sliding shield bore 125, which for this embodiment may be called a cup bore, surrounds a part of the non-moving central assembly 150 comprising the central conductor 109 and the central insulator 111. In the non-connected mode shown in FIG. 2, the sliding shield bore 125 is in contact with an axially front part of the central conductor 109. Moreover, the sliding shield bore (cup bore) 125 is configured to slide outside the central conductor 109 in an axially rearwards direction, when moving from a non-connected state (FIG. 2) towards a connected state (FIG. 5). In addition to the sliding shield bore 125, the sliding shield 123 also has a radially outwardly facing sliding shield face 127, which in this embodiment may be called a sliding cup face. Between the sliding shield face 127 and the sliding shield bore 125, the sliding shield 123 further comprises a tapered face 129. The tapered face 129 abuts an opposite tapered face of the moving insulator 111.

A cylindrical wall 131 constitutes a substantial part of the outer boundary of the dielectric chamber 121, when in the shown non-connected mode, shown in FIG. 2. The cylindrical wall 131 can advantageously also be made of a steel sheet material, for instance of the same sheet material as the sliding shield 123. It has a radially facing inner face, along which the sliding shield face (cup face) 127 of the sliding shield 123 may slide, while remaining in electrical contact with the cylindrical wall 131. On an axial end, opposite the sliding shield 123, the dielectric chamber 121 is further confined by a tapered end portion 133. The tapered end portion 133 can advantageously be a portion of the same component as the cylindrical wall 131. The tapered end portion 133 further has an attachment portion 135, which is attached to the central conductor 109. The attachment portion 135 is in electrical connection with the central conductor 109.

The dielectric chamber 121 is thus, in the shown embodiment, confined by the sliding shield 123, cylindrical wall 131, the tapered end portion 133 and the central conductor 109. Notably, all these components are electrically conductive, and together form an electric shield 130 around the dielectric chamber 121. Also, this electric shield is electrically connected to the central conductor 109, and will thus have the same electric potential (voltage) as the central conductor 109, regardless of being in the connected state or the non-connected state.

While the sliding shield 123 is configured to move axially back and forth, the cylindrical wall 131 and tapered end portion 133 remain attached to the non-moving central conductor 109. To account for the change of volume inside the dielectric chamber 121 during movement between the non-connected mode (FIG. 2) and the connected mode (FIG. 5), a channel 137 leads between the dielectric chamber 121 and a compensation chamber 139. Excessive dielectric liquid is stored in the compensation chamber 139 when the dielectric chamber 121 is in a low volume state. Such a state is shown in FIG. 5 (connected mode).

Outside the cylindrical wall 131 and the tapered end portion 133 there is an outer insulator 141. In this shown embodiment, the outer insulator 141 has a rear bore 143 positioned axially rearwards with respect to the tapered end portion 133. The rear bore 143 surrounds the central conductor 109 in this axial position.

The outer insulator 141 further has a front bore 145 within which the moving insulator 115 is arranged when the connection assembly 1 is in the non-connected mode, as shown in FIG. 2. Between the rear bore 143 and the front bore 145, the outer insulator 141 has an intermediate bore 147. The cylindrical wall 131 abuts this intermediate bore 147. Correspondingly, the tapered end portion 133 abuts a tapered inner face 149 of the outer insulator 141. At an axially front portion of the outer insulator, the outer insulator 141 is arranged within a portion of the receptacle end body 101. Notably, in the non-connected state shown in FIG. 2, both axial end portions of the electric shield 130, has inclined or tapered portions. Also shown in this embodiment, between these tapered portions there is a cylindrical portion, constituted by the cylindrical wall 131. The outer face of the receptacle part 100 is constituted by a plastic mantle 151, along a part of its axial extension.

Figure 3:
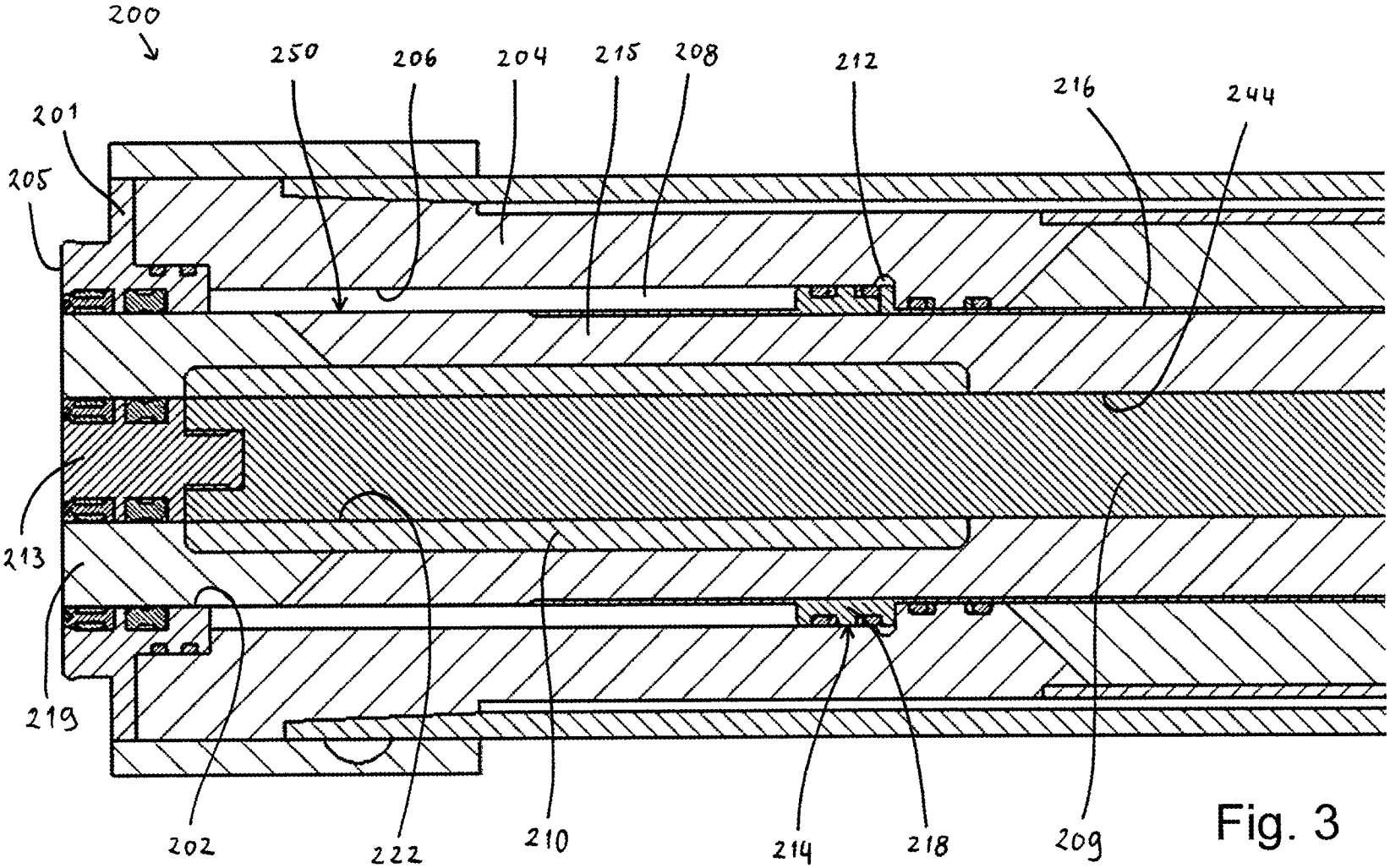
FIG. 3 is a cross section view through the stab part.

FIG. 3 shows a cross section view of the stab part 200 of a connection assembly 1 according to the invention. Similar to the central conductor 109 of the receptacle part 100, the stab part 200 also has main stab conductor, here in the form of a central conductor 209, which typically can be electrically connected to a high voltage cable. In the stab part 200, the central conductor 209 is attached to a central front part 213.

Radially outside the central front part 213, there is arranged a moving front part 219. The moving front part 219 can advantageously be made of a metal, as is also the moving front part 119 of the receptacle part 100. Moreover, the central front part 213 can advantageously also be made of metal, such as the same metal as the moving front part 219.

Axially rearwards of the moving front part 219 there is a moving insulator 215. The moving insulator 215 can be made of a robust, electrically isolating material, such as PEEK.

Radially within a part of the moving front part 219 and a part of the moving insulator 215 there is arranged a moving conductor 210. The moving conductor 210 is made of an electrically conductive material, such as copper. The moving conductor 210 is arranged to slide with continuous electric contact with the central conductor 209. The central conductor 209 of the stab part 200 remains axially fixed when moving between the non-connected and connected modes. The central conductor 209 can be made of the same electrically conducting material as the moving conductor 210, such as copper in this embodiment.

Together, the moving front part 219, the moving conductor 210, and the moving insulator 215 form a conductor receiving bore 244, within which the central conductor 209 and the central front part 213 is arranged. The moving front part 219, the moving conductor 210 and the moving insulator 215 are configured to move in an axially direction while the central conductor 209 and the central front part 213 remains in their position inside the conductor receiving bore 244.

Onto the outer face of the moving insulator 215, there is attached an actuation element 214. In this embodiment, the actuation element 214 comprises an actuation sleeve 216 that extends along a portion of the outer face of the moving insulator 215. The actuation element 214 further comprises a hydraulic actuation piston 218. The hydraulic actuation piston 218 protrudes radially out from the actuation sleeve 216.

Together, the moving front part 219, the moving conductor 210, the moving insulator 215, and the actuation element 214 form a connection body 250. The connection body 250 is configured to move in an axial direction with respect to the rest of the stab part 200. Also, a part of the connection body 250 is configured to be inserted into the receptacle part 100. Such movement will take place when switching from a non-connected mode to a connected mode.

A stab end body 201 is arranged at an axial front end of the stab part 200. The stab end body 201 further has an inner stab end body bore 202 within which the moving front part 219 is arranged when in the non-connected mode. Advantageously, the stab end body 201 is made of metal, and has an end contact face 205, which is configured to abut against the end contact face 105 of the receptacle part 100. In the shown embodiment, the contact face 105 of the receptacle part 100 and the facing end contact face 205 of the stab end body 201 both face in an axial direction. However, in other embodiments, these faces may have other shapes, for instance a tapered configuration.

Axially rearwards of the stab end body 201, the stab part 200 has a stab chamber body 204.

The actuation piston 218 is arranged in a hydraulic connection chamber 212, which is formed as an annulus between the connection body 250 and a chamber bore 206 of the stab chamber body 204.

At an axial front side of the actuation piston 218 (on the left hand side of the piston in FIG. 3), there is a hydraulic disconnection chamber 208. When the moving connection body 250 is in a connected state, being inserted in the receptacle part 100, application of hydraulic pressure inside the hydraulic disconnection chamber 208 will move the hydraulic piston 218 towards a non-connected position. This non-connected position is shown in FIG. 3.

Figure 10:
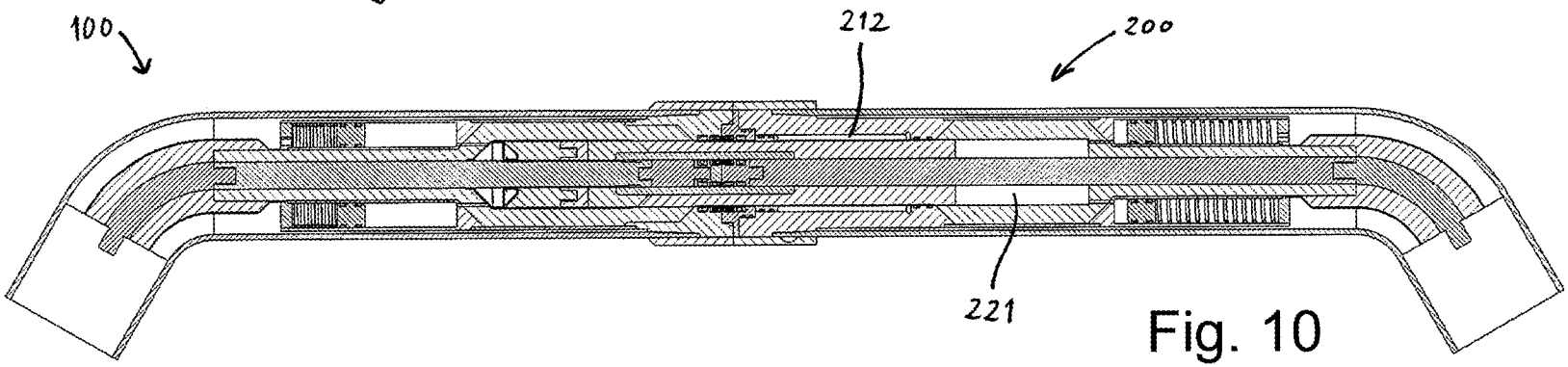
FIG. 10 is a cross section view of the entire connection assembly in a connected state.

Correspondingly, a hydraulic connection chamber 212 is arranged on the axial rear side of the actuation piston 218 (on the right hand side of the piston in FIG. 3). The hydraulic connection chamber 212 is indicated in FIG. 10.

Still referring to FIG. 3, to provide the axial movement of the connection body 250, for insertion into to the receptacle part 100, hydraulic pressure is applied to the hydraulic connection chamber 212. Although not shown in the drawings, the skilled person will appreciate that appropriate hydraulic channels are arranged for communication of hydraulic pressure to the hydraulic chambers.

FIG. 4 shows the axial front portions of both the receptacle part 100 and the stab part 200 in an aligned and abutting position. FIG. 4 depicts the connection assembly 1 in a non-connected mode, but in a position where a connection can be made by insertion of the connection body 250, such as by application of hydraulic pressure in the hydraulic connection chamber 212.

For prevention of water ingress, the central front part 113 of the receptacle part 100, and the central front part 213 of the stab part 200, are provided with a pair of central packers 153, 253. Correspondingly, the receptacle end body 101 and the stab end body 201 are provided with a pair of outer packers 155, 255. As will be appreciated by the skilled person, the outer packers 155, 255 could have been arranged with another component than the receptacle end body 101 and the stab end body 201, provided they are arranged to seal against the moving front parts 119, 219 of the receptacle part 100 and the stab part 200, respectively.

The central packers 153, 253 and the outer packers 155, 255 can be made of any suitable material, such as plastic, rubber or metal. Upon axial movement during a connection or a disconnection procedure, the axially moving parts will slide against the packers.

As discussed above, the central front part 113, the moving front part 119, and the end contact face 105 of the receptacle part 100 can advantageously exhibit front faces of metal. Advantageously, the central front part 213, the moving front part 219, and the end contact face 205 of the stab part 200 can also exhibit front faces of metal. This makes it possible to clean the front of the stab part 200 with a strong water jet and/or brush, without risking harm to the stab part.

While FIG. 4 depicts the situation, where the receptacle part 100 and the stab part 200 are aligned and in position for initiating the connection procedure, FIG. 5 depicts the connected mode. In this position, a part of the connection body 250, which comprises the moving front part 219, moving insulator 215, and the moving conductor 210, has moved axially into the receptacle part 100. During this movement (towards the left in FIG. 5), the moving front part 219 of the stab part 200 has pushed the abutting moving front part 119 of the receptacle part 100 axially into the receptacle part. The sliding shield 123, which connects to the moving front part 119 of the receptacle part via the moving insulator 115, has consequently also been moved further into the receptacle part. As a result, the volume of the dielectric chamber 121 has been reduced. Notably, the sliding shield 123 remains in electric contact with the cylindrical wall 131, and hence the dielectric chamber 121 is still encompassed by the electric shield 130. Excessive dielectric liquid has been displaced into the compensation chamber 139, through the channel 137.

Notably, in the connected mode, as shown in FIG. 5, a portion of the axial extension of the moving conductor 210 overlaps with the central conductor 109 of the receptacle part. At the location of this axially overlapping portion, the electric connection between the stab part and receptacle part takes place.

As shown in FIG. 2 and in FIG. 5, there is a connection arrangement slidably arranged on the central conductor 109. In this embodiment, the connection arrangement has the form of a sliding connection sleeve 157. The connection sleeve 157 has a sleeve portion 159, which is shaped as a sleeve with a bore that receives the central conductor 109. Further, the connection sleeve 157 has an engagement element 161, which is configured to engage with the sliding shield 123 when the latter is moved in the disconnection direction (i.e. towards the right in FIG. 5).

Figure 6:
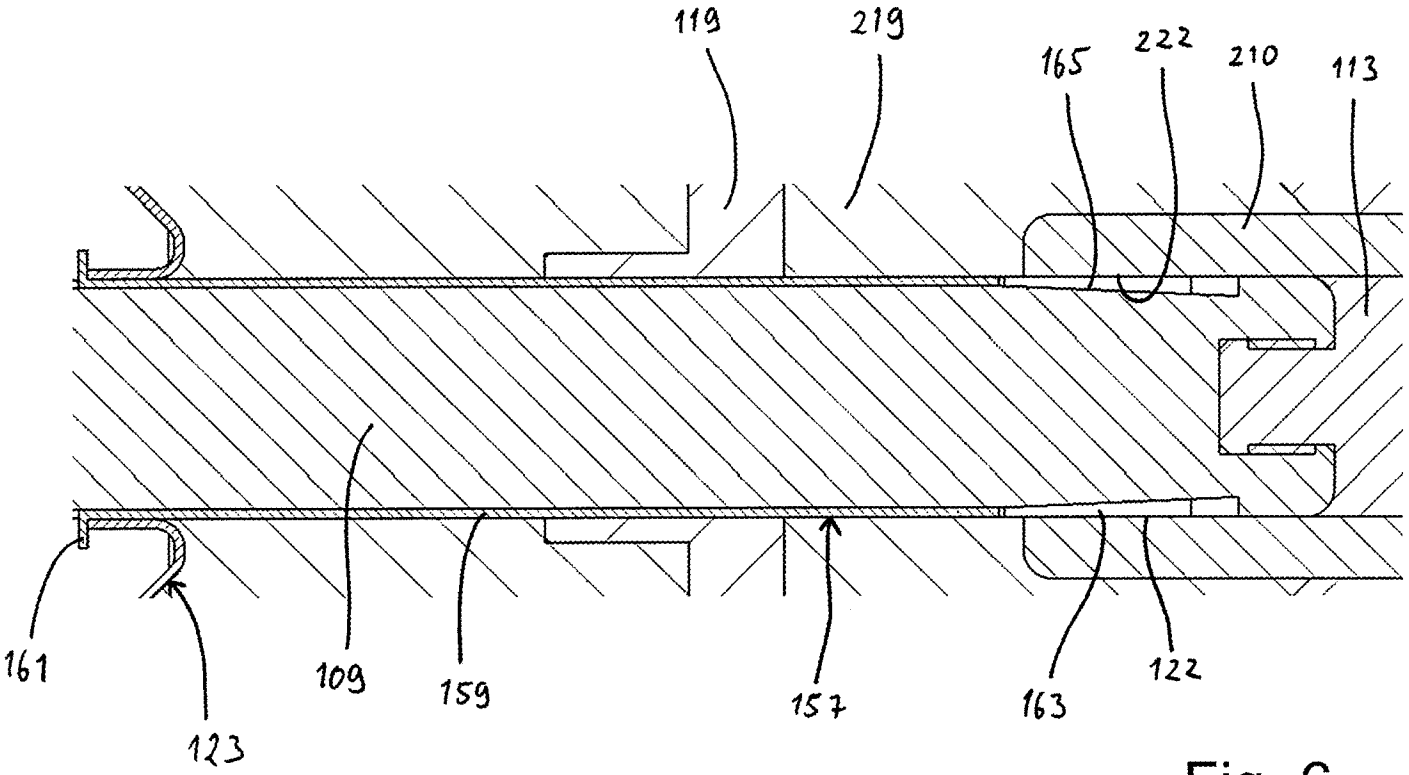
FIG. 6 is an enlarged cross section side view showing a connection sleeve in detail.

In the said overlapping portion, where the axial extension of the moving conductor 210 overlaps with the central conductor 109 of the receptacle part 100, the connection sleeve 157 further comprises radially movable contact elements, here in the form of connection fingers 163. The connection fingers 163 extend in a substantial axial direction as separate parts out from the sleeve portion 159. In this shown embodiment, their radial thickness increases somewhat along the axial direction, towards the axial front end of the receptacle part 100 (i.e. towards the position of the central front part 113). The connection fingers 163 rest on a tapered connection face 165 arranged on the central conductor 109. The tapered connection face 165 is recessed compared to the general cylindrical outer surface of the central conductor 109. FIG. 6 illustrates the connection sleeve 157 in better detail.

In this embodiment, on the radial outwardly facing face of the connection fingers 163, the receptacle contact faces 122 are positioned. As explained above, when sliding the connection sleeve 157 on the main receptacle conductor/central conductor 109, the connection fingers 163 will be forced radially outwards so that the contact faces 122 abuts the stab contact bore, here in the form of the inner contact bore 222.

During the connection movement, i.e. when the connection body 250 moves axially when being inserted into the receptacle part 100, a part of the sliding shield 123 is configured to engage the engagement element 161 of the connection sleeve 157. Because of this engagement, the connection sleeve 157 is also moved in the axial direction, along with the sliding shield 123. The connection sleeve 157 slides rearwards on the axially fixed central conductor 109 of the receptacle part 100. This further moves the connection fingers 163 along the tapered connection face 165, in such manner that their radial position is moved or lifted radially outwards. This radial movement of the connection fingers 163 forces them into abutment with the moving conductor 210 of the stab part 200. The moving conductor 210 has a stab contact face, which constitutes the contact face that provides the electric contact between the receptacle part 100 and the stab part 200 when in the connected mode. In this embodiment, the stab contact face is in the form of an inner contact bore 222, against which the connection fingers 163 abuts. This abutment ensures electrical connection between the central conductor 109 and the moving conductor 210, as the connection sleeve 157 is always in electric contact with the central conductor 109.

Notably, when the contact between the inner contact bore 222 (stab contact face) and the receptacle contact face 122 (on the connection fingers 163) is made, there is no mutual axial movement between these faces. That is, these faces are only moved towards each other along their facing direction. Because of such gentle handling without sliding, their faces may be coated with a soft metal suitable for establishing electric contact, such as gold, without damaging the faces when making or removing the contact.

Advantageously, the connection sleeve 157 can be made of the same material as the central conductor 109, such as copper. The inner contact bore 222 is a part of the conductor receiving bore 244 (shown in FIG. 3).

When the connection body 250 is pulled back, such as by application of hydraulic pressure in the hydraulic disconnection chamber 208 (cf. FIG. 3), the moving front part 119, moving insulator 115, sliding shield 123, and the connection sleeve 157 will follow. The sliding shield 123 will however move until the moving front part 119 is positioned back in its non-connected position, as shown in FIG. 2.

Figure 7:
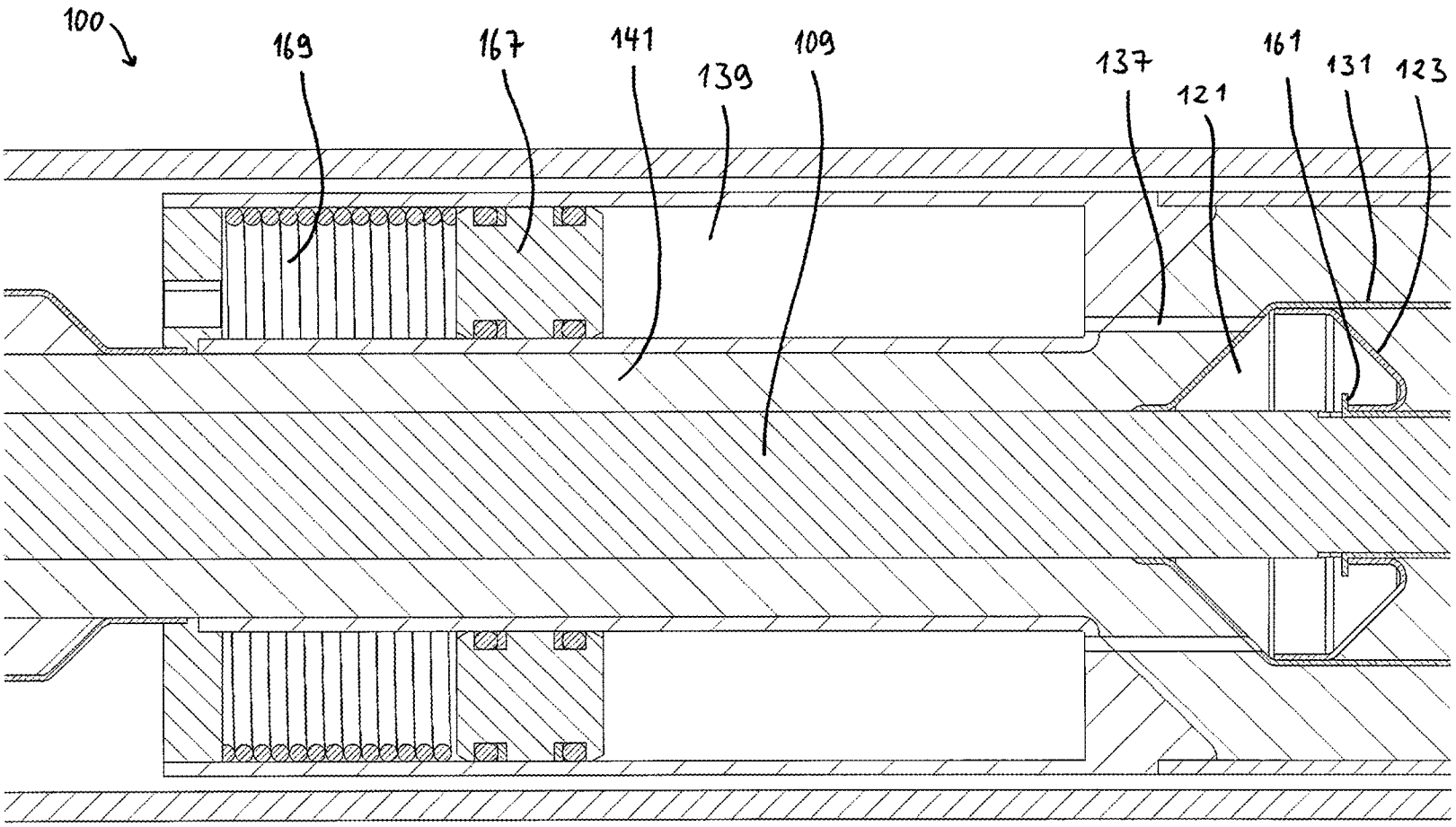
FIG. 7 is an enlarged, cross section view through a rear portion the receptacle part shown in the connected position.

FIG. 7 depicts the axially rear portion of the receptacle part 100. In this view, the compensation chamber 139 is shown in better detail. The compensation chamber 139 is shaped as an annulus in which there is provided a compensation piston 167. The compensation piston 167 is configured to move back and forth in the compensation chamber 139, upon flow of dielectric fluid into and out from the compensation chamber 139. Between the compensation piston 167 and a rear end of the compensation chamber 139, there is arranged a compensation spring 169. The compensation spring 169 is always in a compressed state, thereby providing a pressure in the dielectric liquid in the compensation chamber 139 as well as in the dielectric chamber 121. This liquid pressure forces the sliding shield 123 towards the non-connected position (as shown in FIG. 2), thereby moving the sliding shield 123 when the connection body 250 is pulled out from its engagement with the receptacle part 100.

Figure 8:
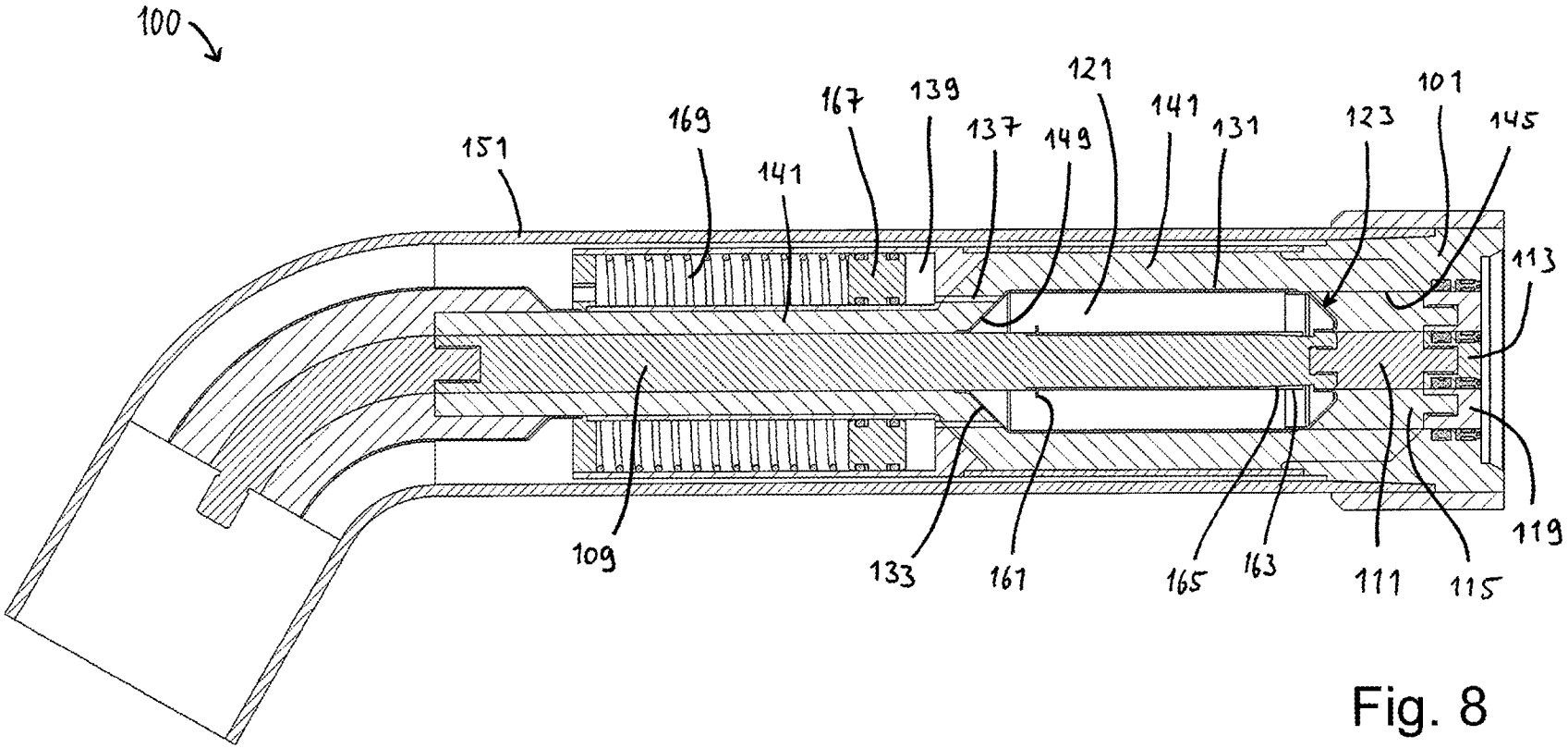
FIG. 8 is a cross section view of the receptacle part in a non-connected state.

FIG. 8 is an enlarged cross section view of the entire receptacle part 100, of the above described embodiment of a high voltage wet-mate connection assembly 1 according to the invention. In FIG. 8 the receptacle part 100 is shown in the non-connected state, as the moving front part 113, moving insulator 115, and the sliding shield 123 are in the axially forward position.

Figure 9:
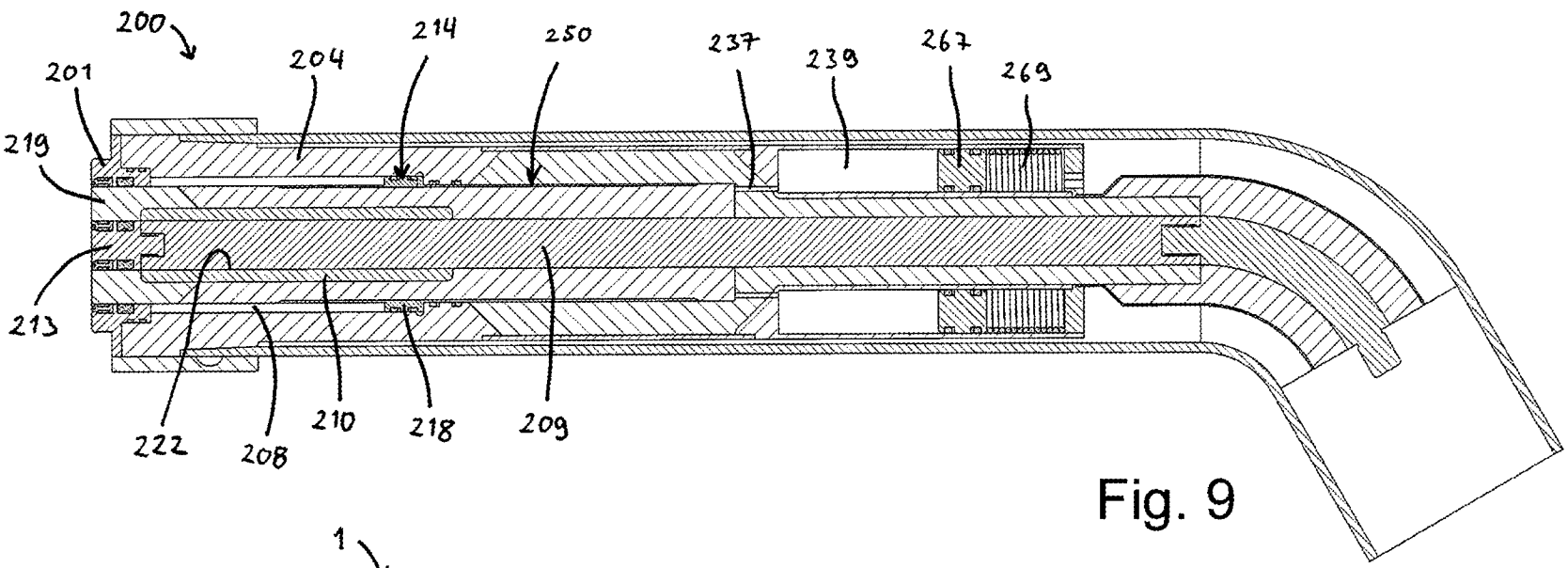
FIG. 9 is a cross section view of the stab part in a non-connected state.

FIG. 9 is an enlarged cross section view of the entire stab part 200, in the non-connected state. Similar to the receptacle part 100, the stab part 200 is also provided with a compensation chamber 239, a channel 237, a compensation spring 269 and a compensation piston 267. This compensation solution will compensate for the volume axially rearwards of the connection body 250 when this is moved axially into the receptacle part 100. As shown in the view of FIG. 10, a dielectric chamber 221 appears when the connection body 250 moves towards the connected position.

FIG. 10 depicts the high voltage wet-mate connection assembly 1 in a connected mode.

It is again reverted to FIG. 4 and FIG. 5, illustrating the connection assembly 1 in the non-connected and the connected mode, respectively. FIG. 4 depicts the receptacle part 100 and the stab part 200 in an abutting and aligned, but not connected position. In this situation, the central packers 153, 253 and the outer packers 155, 255 are surrounded by metal. More precisely, they are surrounded by the metal of the central front parts 113, 213, and the moving front parts 119, 219. Furthermore, as shown in FIG. 5, which illustrates the connected mode, the packers that are in the area of possible high voltage, namely the central packers 153, 253, are surrounded by metal also in the connected mode. Here, the central packers 153, 253 are surrounded radially outside by the moving conductor 210 of the stab part 200. The outer packers 155, 255 are not completely encapsulated by metal, however in the connected mode they are not in the area of possible high voltage. Furthermore, in the non-connected mode, the outer packers 155, 255 are not exposed to any electrical fields that may lead to degradation of the packer material.

A result of this is that the packers will not be exposed to large electrical fields that could result in damage to the packers. Thus, while the feature of having front faces of metal makes it more feasible to clean, having front parts of metal also protects the packers from being harmed due to high voltages.

Figure 11:
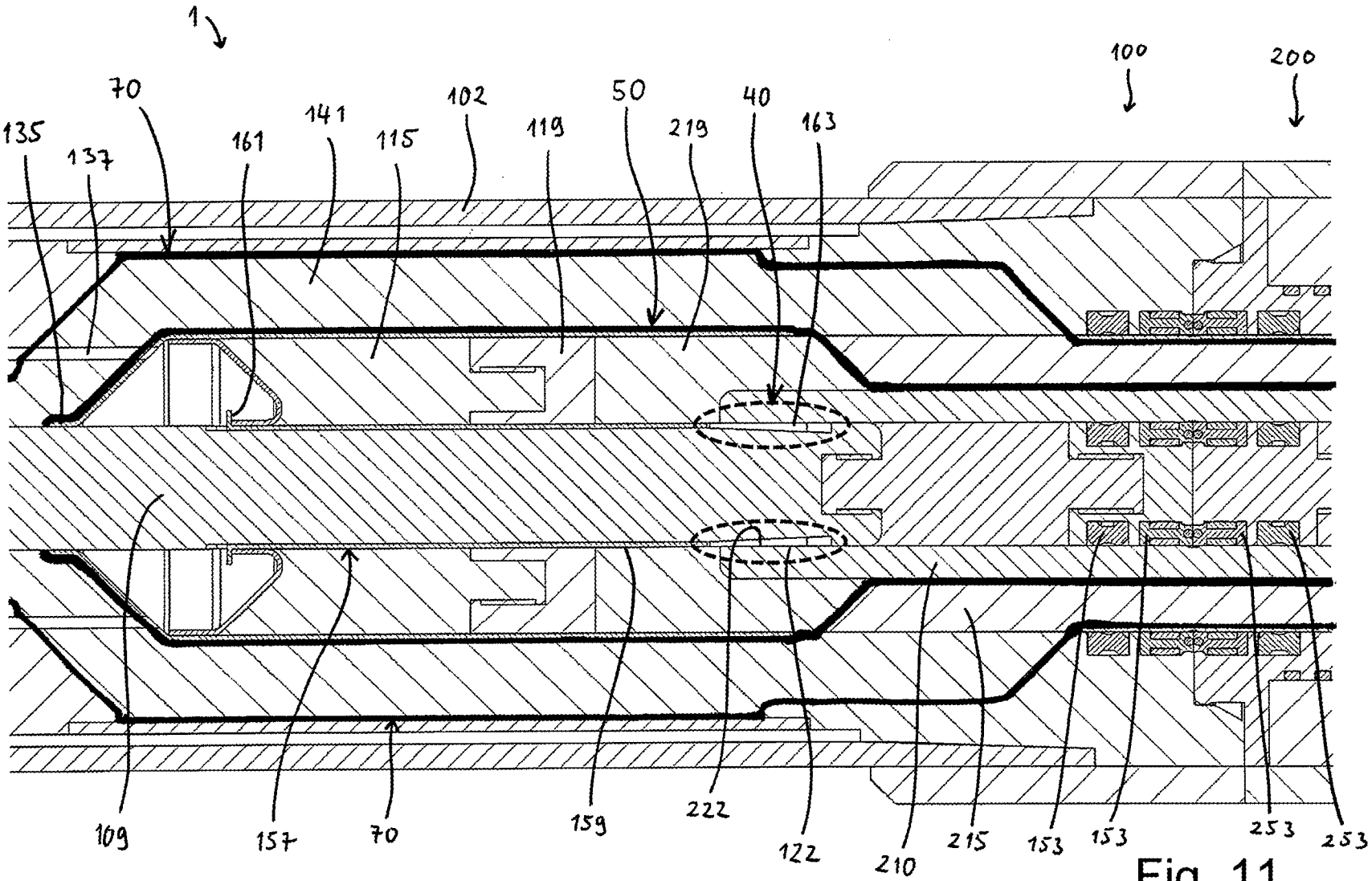
FIG. 11 is a cross section view corresponding to FIG. 5, illustrating the connected mode metal encapsulation.

FIG. 11 is a cross section view of the connection assembly 1 according to the invention in the connected mode. The contact location 40 of contact between the stab contact face and the receptacle contact face is shown with dashed line circles. In this embodiment, the stab contact face is on the inner contact bore 222 of the moving conductor 210, while the receptacle contact face is constituted by the outer faces 122 of the connection fingers 163.

The inner thick black lines introduced in FIG. 11 represent the outer rim or outer face of a connected mode metal encapsulation 50. The outer rim of the connected mode metal encapsulation 50 extends along outer faces of metal components that all have the same electric potential/voltage as the central conductor 109. As is clearly visible from FIG. 11, this outer rim is arranged at a distance, herein termed shield distance, from the said contact location 40. In particular, there is no position of contact between the stab contact face 222 and the receptacle contact face 122, which is arranged in the vicinity of the connected mode metal encapsulation. This applies regardless of measured along a radial, axial or inclined direction.

Notably, in this embodiment the axially front portion of the central conductor/receptacle main conductor 109 may abut the inner contact bore 222 of the moving conductor 210. Thus, electric connection between the receptacle part and stab part may also exist at this location. In addition, electric contact may be present between the sleeve portion 159 of the connection sleeve 157, and the moving front part 219 of the stab part 200. Notably, the outer rim of the connected mode metal encapsulation 50 is arranged at a distance also from these possible contact faces. Even the moving front part 119 of the receptacle part may constitute electrical connection between the receptacle part 100 and the stab part 200, as it abuts both the sleeve portion 159 and the moving front part 219 of the stab part 200, when in the connected mode.

As the skilled person will appreciate though, the contact provided at the contact location 40 (i.e. where the radially movable contact elements, namely the connection fingers 163 in this embodiment, makes the electric connection) constitutes the main electrical contact of the connection assembly when in the connected mode.

At the area of the contact location 40, the components of the connected mode metal encapsulation 50 are, in this embodiment, the moving conductor 210 and the moving front part 219, which are both components of the connection body 250 of the stab part 200.

It is again referred to FIG. 11, which depicts an embodiment of the invention when in a connected mode. Outside the connected mode metal encapsulation 50, there is a connected mode insulation assembly 70, which encapsulates the connected mode metal encapsulation 50. The periphery of the connected mode insulation assembly 70 is indicated with the two outer thick black lines. In this embodiment, the connected mode insulation assembly 70 comprises the outer insulator 141 of the receptacle part 100 and the moving insulator 215 of the receptacle part 200. As can be seen in FIG. 11, the connected mode insulation assembly 70 extends axially from the central conductor 109 at a position rearwards of the connected mode metal encapsulation 50, to the outer face of the moving conductor 210.

In the shown embodiment, a portion of the connection body 250 of the stab part 200, namely the moving insulator 215, forms a part of the connected mode insulation assembly 70 when in the connected mode. As can be seen in FIG. 11, the connected mode insulation assembly 70 extends into the stab part 200, surrounding the moving conductor 210. As can be seen from FIG. 3, the moving insulator 215 extends axially rearwards beyond the extension of the moving conductor 210, and contacts the main stab conductor 209 (central conductor). The connected mode metal encapsulation 50 is completely surrounded by and in contact with the insulating material of the connected mode insulation assembly 70. The channel 137, which extends through the insulating material of the outer insulator 141 and an aperture in the tapered end portion 133, is filled with dielectric fluid, which also is an insulating material.

Figure 12:
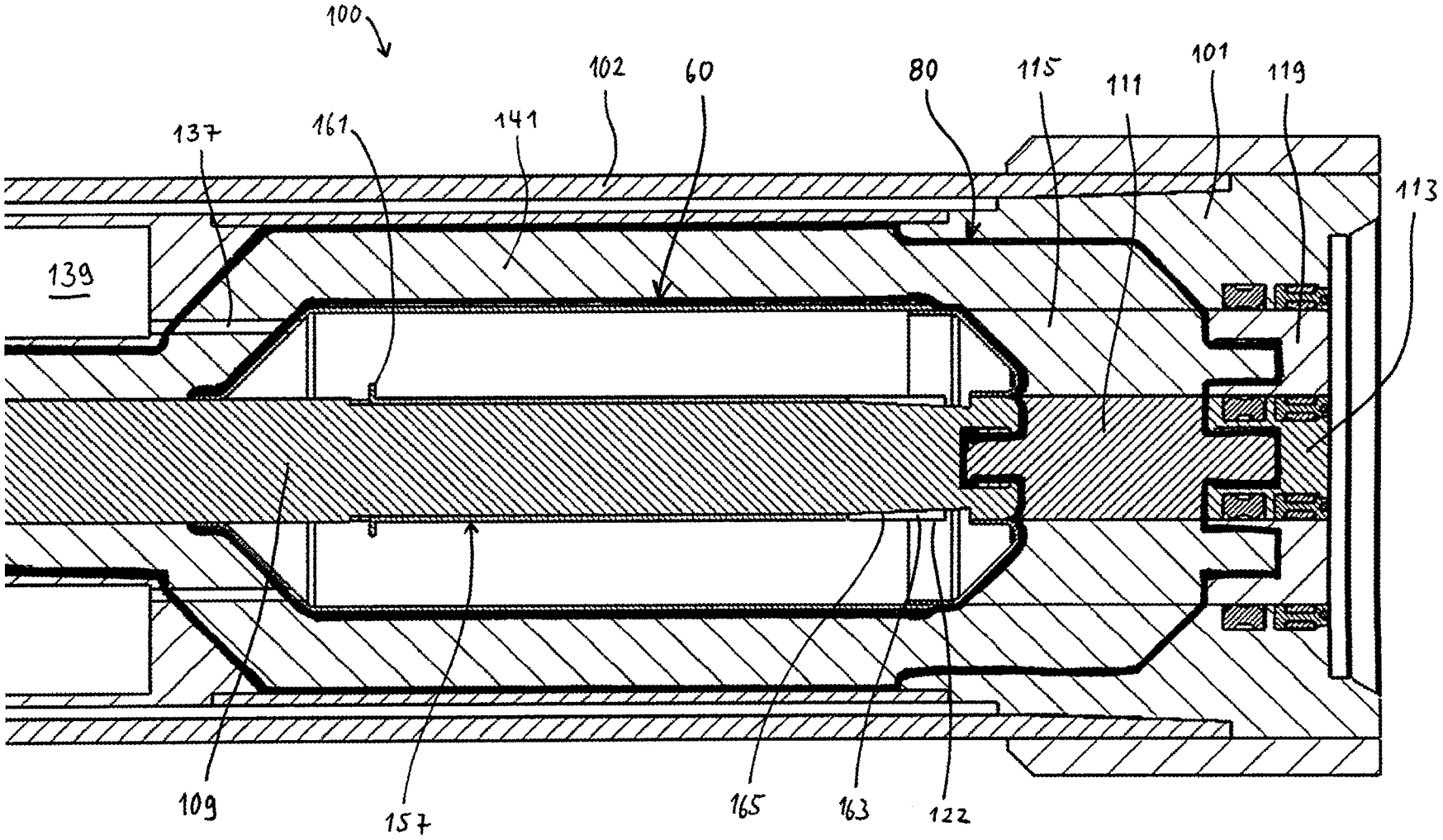
FIG. 12 is a cross section view corresponding to FIG. 2, illustrating the non-connected mode metal encapsulation.

FIG. 12 depicts the receptacle part 100 in the non-connected mode. Corresponding to the view of FIG. 11, a non-connected mode metal encapsulation 60 is indicated with an inner thick black line. The outer rim of the non-connected mode metal encapsulation 60 also follows the outer faces of metal parts that surrounds the receptacle contact face, namely the outer faces 122 of the connection fingers 163. Notably, this outer rim is arranged at a substantial distance away from the receptacle contact face. Hence, even if voltage is applied to the central conductor 109 when in the non-connected mode of the connection assembly 1, the receptacle part 100 will not become damaged. That is, there will not be any significant electric fields at the area of the receptacle contact face, since it is placed within the non-connected mode metal encapsulation 60.

Corresponding to the connected mode insulation assembly 70 discussed with reference to FIG. 11, there is a non-connected mode insulation assembly 80, which now will be discussed with reference to FIG. 12. The outer perimeter of the non-connected mode insulation assembly 80 is indicated with the outer thick lines. The non-connected mode insulation assembly 80 comprises the outer insulator 141, moving insulator 115, and the central insulator 111, which are all parts of the receptacle part 100. As appears from FIG. 12, the non-connected mode insulation assembly 80 encapsulates the non-connected mode metal encapsulation 60 completely at the axial front end. Rearwards it encloses the non-connected mode metal encapsulation 60 all the way to the position behind the latter, where the non-connected mode insulation assembly 80 is in contact with the central conductor 109.

Thus, both the connected mode insulation assembly 70 and the non-connected mode insulation assembly 80 provides a barrier of insulating material between, respectively, the connected mode metal encapsulation 50 and the non-connected mode metal encapsulation 60, and the outer metal structure of the connection assembly 1, such as the receptacle end body 101 and outer structure sleeve 102.

The attachment portion 135 of the tapered end portion 133 of the electric shield 130 constitutes the rear end part of both the connected mode metal encapsulation 50 and the non-connected mode metal encapsulation 60. Behind this position, i.e. the position of the attachment portion 135, the main receptacle conductor (central conductor) 109 constitutes the outer face of the high voltage carrying metal, in this embodiment.

The skilled person will appreciate that the instead of moving connection elements, such as the connection fingers 163, radially outwards into connected state, one can also use other designs that moves connection element(s) radially inwards.

A notable advantage of the discussed metal encapsulations 50, 60, is that one may design connection elements/contact faces without taking account of large electric fields. Due to this fact, one does not need to avoid sharp edges or small parts, which in prior art solutions would be unacceptable due to the electric fields that could affect them, or that could affect the insulating material.

Yet a notable advantage is the comparatively small size and weight, which the disclosed design renders possible. In some embodiments, a high voltage connection assembly 1 according to the present invention may typically have a mass of about 10 kg. This is a significant reduction compared to prior assemblies known to the applicant, which may have a mass of about 140 kg.

In addition to make the front faces of the receptacle part 100 and the stab part 200 more tolerant to being cleaned by a strong water jet, it should also be mentioned that by avoiding insulating materials at the front faces, the assembly is less prone to water ingress with possible resulting material expansion. Such problems are known for instance when using PEEK in contact with seawater.

The connection assembly according to the present invention also reduces the exposure of water to the connection faces. Such exposure may result in fouling and deterioration of the contact faces. Notably, with the design according to the example embodiment, no insulating material, nor any conductors are exposed to seawater. This applies to both the connected and the non-connected mode.

In the discussed example embodiment, a connection body stabs into the receptacle part from the stab part. Moreover, this shown connection body comprises an inner bore, thereby having the shape of a sleeve. Notably, by stabbing a connection body that has ha sleeve design, the front surface/front area is less than conventional stab part pin. As a result, less seawater, typically trapped between the front face of the connection body and the facing front face of the receptacle part, is moved into the receptacle part. This reduces the amount of seawater that might pollute the inside of the receptacle part, and in particular the dielectric fluid (such as in the dielectric chamber 121).

As appears from FIG. 11 and FIG. 12, the engagement element 161 is always within the metal encapsulations 50, 60, and will thus not be exposed to excessive electric fields. Consequently, there are less design constraints with regard to its shape.

Figure 13:
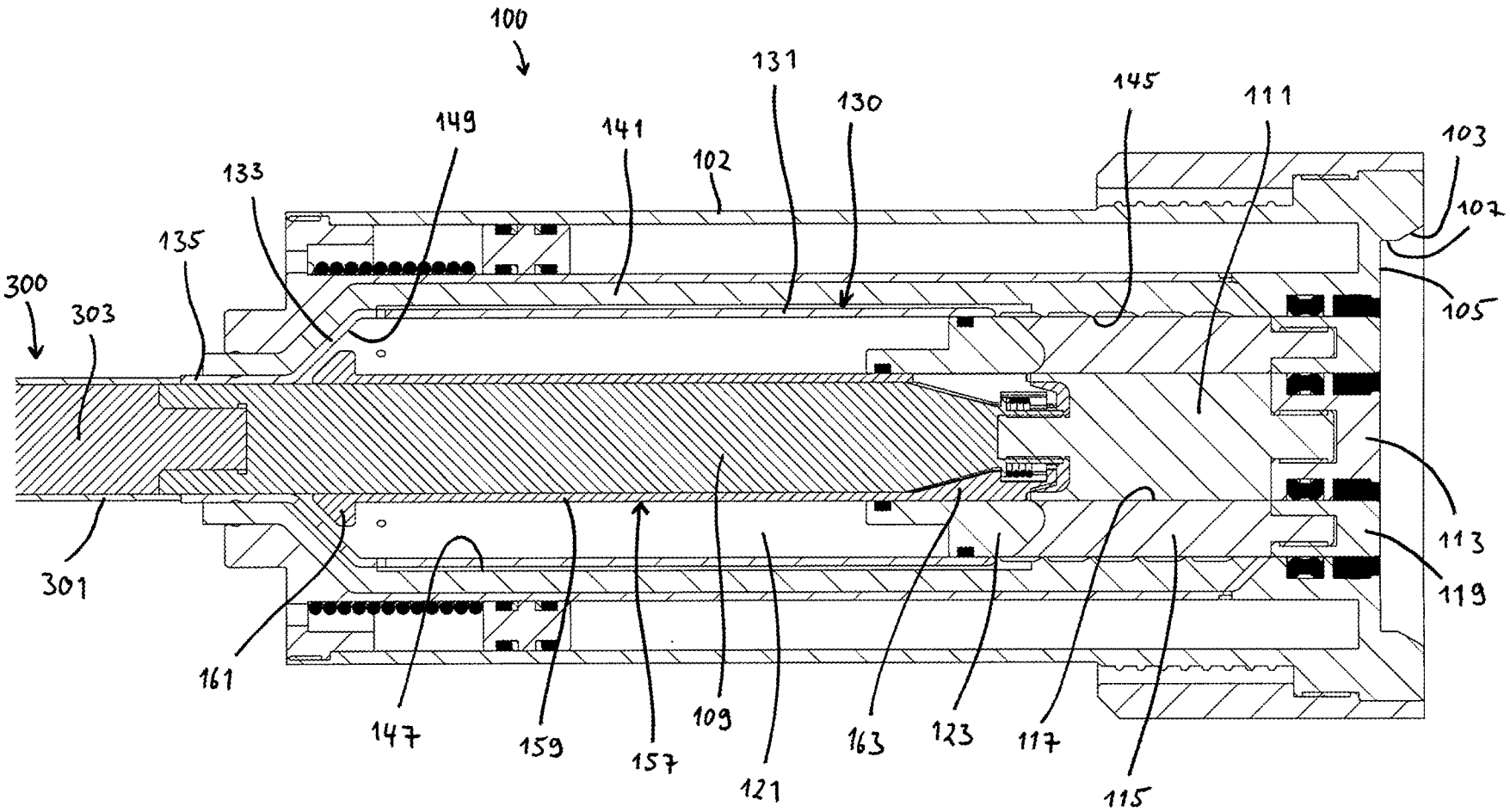
FIG. 13 is a cross section side view of the receptacle part of an alternative embodiment according to the present invention, shown in the non-connected mode.
Figure 14:
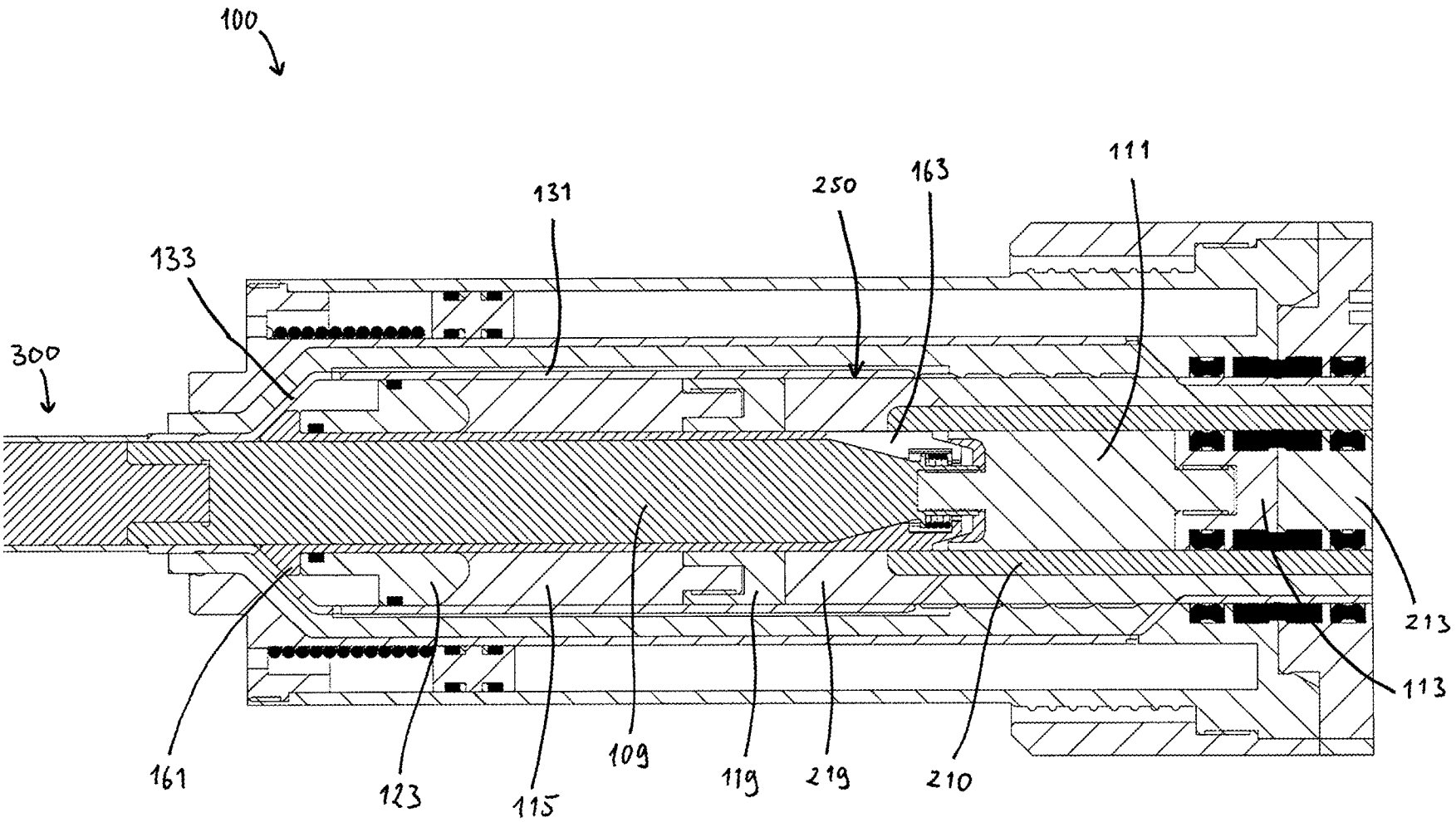
FIG. 14 is a cross section side view of the alternative embodiment shown in FIG. 13, shown in the connected mode.

FIG. 13 and FIG. 14 are cross section views showing an alternative embodiment of the present invention. It will be appreciated that, while there are some differences in design, the main components in this embodiment correspond to the components of the embodiment discussed above.

As with the previously discussed embodiment, the tapered end portion 133 of the electric shield 130 has an attachment portion 135 that connects to the central receptacle conductor 109. However, contrary to the embodiment discussed above, in the embodiment shown in FIG. 13 and FIG. 14, the attachment portion 135 extends further axially rearwards, axially beyond the outer insulator 141. In the shown embodiment, the attachment portion 135 abuts against a semiconductor material coating 301 that is arranged on a cable conductor 303 of a cable 300 that is connected to the receptacle part 100. For illustrational purpose, only the cable conductor 303 and the semiconducting material coating 301 of the cable 300 are shown. It will be clear to the skilled reader, however, that the cable 300 may comprise additional components such as insulating and protective sheaths.

In the embodiment shown in FIG. 13 and FIG. 14, the connection sleeve 157 is provided with another shape of the engagement element 161. In this embodiment, the engagement element 161 is configured to abut the tapered end portion 133 when in the connected mode. Moreover, the sliding shield 123 is in this embodiment not manufactured with a sheet material, but is rather a solid sleeve part with an inner bore sliding on the sleeve portion 159 of the connection sleeve 157.

Figure 15:
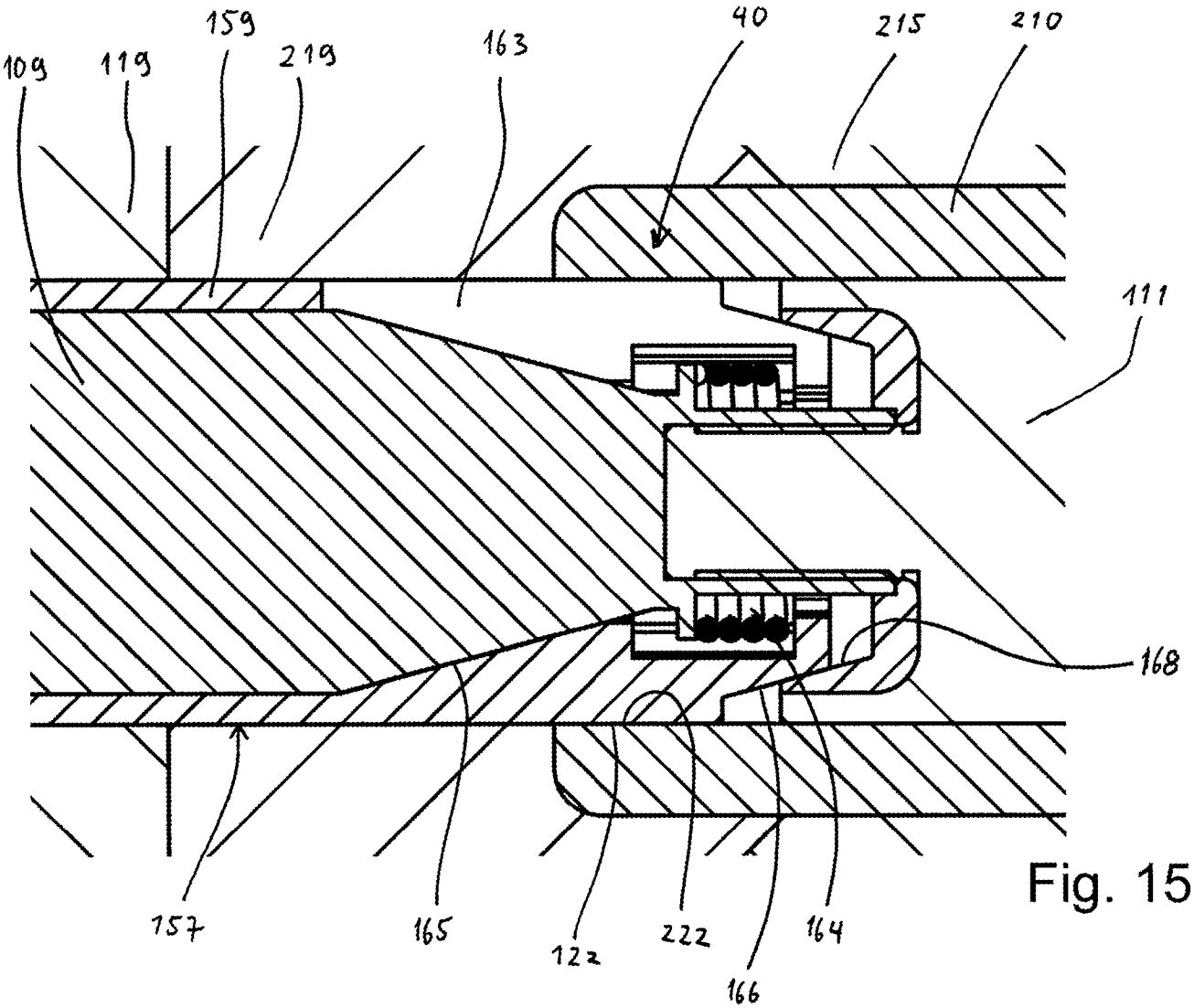
FIG. 15 is an enlarged section view of FIG. 14.

FIG. 15 is an enlarged cross section view including the contact location 40, where the electrical contact between the receptacle part 100 and the stab part 200 takes place, namely where the receptacle contact face 122 abuts the stab contact face 222. In this and the previously discussed embodiment, the stab contact face 222 is constituted by the inner contact bore 222 arranged in the moving conductor 210 of the stab part 200.

In order to move the sleeve connection 157 and thus the connection fingers 163 out of contact engagement, i.e. into the non-connected mode, there is arranged a disconnecting spring 164. The disconnecting spring 164 is compressed between a shoulder on the central receptacle conductor 109 and a shoulder on the connection fingers 163, thus providing a force onto the connection fingers towards the non-connected mode position.

Also arranged on the connection fingers 163 are disconnecting finger faces 166 that are configured to slide on an inclined disconnecting sliding face 168 that is arranged on the central insulator 111. The mutual engagement between the inclined disconnecting sliding face 168 and the disconnecting finger face 166 will ensure that the connection fingers 163 are moved radially inwards and hence out of connection with the stab contact face 222 when the connection body 250, including the stab contact face 222, is pulled out from the receptacle part 100.

Notably, as shown with the discussed example embodiments, the connected mode metal encapsulation 50 is made up of metal parts of the receptacle part 100 and metal parts of the connection body of the stab part 200. This may also relate to other embodiments of the invention.

While various aspects of the present invention has been illustrated with the above detailed example of embodiment, the skilled person will appreciate that a plurality of other embodiments are feasible within the scope of the claimed invention.

The invention claimed is:

1. A high voltage wet-mate connection assembly configured to be switched between an electrically non-connected mode and an electrically connected mode, comprising:

a receptacle part and a stab part, the receptacle part comprising a main receptacle conductor and the stab part comprising a main stab conductor;

wherein the stab part comprises an axially movable connection body movable with respect to the stab part, which is configured to move between a non-connected position and a connected position, the connected position being a position where the connection body is in a state inserted into the receptacle part;

wherein the connection body comprises a stab contact face configured to engage a receptacle contact face of the receptacle part at a contact location when in the connected state, thereby providing an electric connection between the main receptacle conductor and the main stab conductor;

a connected mode metal encapsulation, the outer faces of which encapsulate the contact location at a shield distance from the contact location, when in the connected position; and wherein the connected mode metal encapsulation is in electrical contact with the main receptacle conductor, thereby having the same electric potential as the main receptacle conductor.

2. The high voltage wet-mate connection assembly according to claim 1, wherein the high voltage wet-mate connection assembly further comprises one or more radially movable contact elements, on which the receptacle contact face or the stab contact face is arranged.

3. The high voltage wet-mate connection assembly according to claim 2, wherein the one or more radially movable contact elements carry the receptacle contact face and is/are configured to move radially outwards when moving from the non-connected mode to the connected mode.

4. The high voltage wet-mate connection assembly according to claim 1, wherein the components that constitute the connected mode encapsulation are configured to remain in a constant radial position when the connection assembly switches between the connected mode and the non-connected mode.

5. The high voltage wet-mate connection assembly according to claim 2, comprising:

a non-connected mode metal encapsulation, the outer faces of which encapsulate the radially movable contact elements with a shield distance when in the non-connected mode; and wherein the non-connected mode metal encapsulation is in electrical contact with the main receptacle conductor, thereby having the same electric potential as the main receptacle conductor.

6. The high voltage wet-mate connection assembly according to claim 1, wherein the connected mode metal encapsulation, when in the connected mode, is encapsulated by a connected mode insulation assembly.

7. The high voltage wet-mate connection assembly according to claim 5, wherein the non-connected mode metal encapsulation, when in the non-connected mode, is encapsulated by a non-connected mode insulation assembly.

8. The high voltage wet-mate connection assembly according to claim 1, wherein:

the axially movable connection body of the stab part comprises a central bore; and a central front part of the receptacle part is configured to be positioned within the central bore when in the connected mode.

9. The high voltage wet-mate connection assembly according to claim 1, wherein the receptacle part comprises an axially retractable sleeve part, which is configured to be axially moved by a force exerted by the front face of a moving front part of the stab part.

10. The high voltage wet-mate connection assembly according to claim 1, wherein a receptacle part front face comprises front faces of a central front part, a moving front part, and a receptacle end body, wherein the front faces comprise metal.

11. The high voltage wet-mate connection assembly according to claim 1, wherein a stab part front face comprises front faces of a central front part, a moving front part and a stab end body, wherein the front faces comprise metal.

12. The high voltage wet-mate connection assembly according to claim 1, wherein:

the receptacle part comprises packers arranged to slide against the connection body; and the packers are arranged within the connected mode metal encapsulation and within a shield distance from the outer faces of the connected mode metal encapsulation, when in the connected mode.

13. The high voltage wet-mate connection assembly according to claim 1, wherein the connected mode metal encapsulation is in contact with a semiconductor coating of a cable connected to the receptacle part.

* * * * *